US008603298B2

(12) United States Patent
Nomura

(10) Patent No.: US 8,603,298 B2
(45) Date of Patent: Dec. 10, 2013

(54) METHOD OF MANUFACTURING COATED PAPER

(75) Inventor: Akira Nomura, Sakura (JP)

(73) Assignee: Daio Paper Corporation, Ehime (JP)

( * ) Notice: Subject to any disclaimer, the term of this patent is extended or adjusted under 35 U.S.C. 154(b) by 371 days.

(21) Appl. No.: 12/226,936

(22) PCT Filed: May 2, 2007
(Under 37 CFR 1.47)

(86) PCT No.: PCT/JP2007/059360

§ 371 (c)(1),
(2), (4) Date: Jan. 29, 2009

(87) PCT Pub. No.: WO2007/129654

PCT Pub. Date: Nov. 15, 2007

(65) Prior Publication Data

US 2009/0151883 A1 Jun. 18, 2009

(30) Foreign Application Priority Data

May 2, 2006 (JP) ..... 2006-128701

(51) Int. Cl.
*D21H 23/70* (2006.01)

(52) U.S. Cl.
USPC ..... 162/163; 162/135; 162/137; 162/205; 427/321; 427/361; 427/391; 427/428.01

(58) Field of Classification Search
USPC ..... 162/134–137, 204–206; 427/211, 299, 427/331, 355, 359, 361, 365, 391, 402, 420, 427/421.1, 428.01
See application file for complete search history.

(56) References Cited

U.S. PATENT DOCUMENTS

| | | | | |
|---|---|---|---|---|
| 3,257,234 | A * | 6/1966 | Porter et al. | 427/338 |
| 5,169,715 | A | 12/1992 | Maubert et al. | |
| 7,485,359 | B2 * | 2/2009 | Tamagawa | 428/141 |
| 2002/0100566 | A1 * | 8/2002 | Lee et al. | 162/166 |
| 2004/0060676 | A1 * | 4/2004 | Gron et al. | 162/123 |
| 2004/0131871 | A1 * | 7/2004 | Lee et al. | 428/481 |
| 2005/0089641 | A1 * | 4/2005 | Fors et al. | 427/365 |
| 2006/0191654 | A1 * | 8/2006 | Theisen et al. | 162/135 |
| 2006/0207735 | A1 * | 9/2006 | Blanz et al. | 162/111 |
| 2007/0054117 | A1 * | 3/2007 | Katchko et al. | 428/346 |
| 2007/0295466 | A1 * | 12/2007 | Fugitt et al. | 162/115 |
| 2008/0254298 | A1 * | 10/2008 | Fugitt et al. | 428/409 |
| 2008/0268158 | A1 * | 10/2008 | Fugitt et al. | 427/373 |
| 2009/0151883 | A1 * | 6/2009 | Nomura | 162/136 |
| 2009/0324980 | A1 * | 12/2009 | Matsushima | 428/537.5 |

FOREIGN PATENT DOCUMENTS

| | | |
|---|---|---|
| JP | H-5-051898 | 3/1993 |
| JP | H7-505573 | 6/1995 |
| JP | H10-168792 | 6/1998 |
| JP | 2001-073295 | 3/2001 |
| JP | 2001-254295 | 9/2001 |
| JP | 2004-530063 | 9/2004 |

(Continued)

*Primary Examiner* — Jose A Fortuna
(74) *Attorney, Agent, or Firm* — DLA Piper LLP (US)

(57) ABSTRACT

A method of manufacturing coated paper which consistently performs a papermaking process, a coating process, and a flattening process and includes a coating facility formed of a combination of a roll coater coating facility and first and second coating facilities in which coating methods are different from that of the roll coater coating facility, and the roll coater coating facility is provided between the first and second coating facilities.

3 Claims, 10 Drawing Sheets

(56) References Cited

FOREIGN PATENT DOCUMENTS

| | | | |
|---|---|---|---|
| JP | 2004-300607 | | 10/2004 |
| JP | 2004-353123 | | 12/2004 |
| JP | 2005-009053 | | 1/2005 |
| JP | 2005-154951 | | 6/2005 |
| JP | 2006-037257 | | 2/2006 |
| JP | 2007-031925 | A | 2/2007 |
| WO | WO 99/55966 | | 11/1999 |
| WO | WO 2004/094725 | | 11/2004 |
| WO | WO 2006137328 | A1 * | 12/2006 |

* cited by examiner

METHOD OF MANUFACTURING COATED PAPER

TECHNICAL FIELD

The present invention relates to a method of manufacturing coated paper.

Particularly, the present invention relates to a method of manufacturing coated paper on a so-called on-machine that can efficiently produce coated paper by consistently performing a papermaking process, a coating process, and a flattening process. The method can efficiently produce various kinds of coated paper, such as coated paper having a small amount of a coating material, coated paper having a large amount of a coating material, and coated paper having different amount of a coating material on the front and back surfaces thereof by providing combined coating facilities having different coating methods as means for forming a coating layer on at least one surface of base paper so that the proper coating facility can be selected.

More particularly, the present invention relates to a method of manufacturing coated paper where a roll coater coating facility is provided between a first coating facility for forming a coating layer on the surface of base paper and a second coating facility for forming a coating layer on the back surface of base paper, and which can efficiently produce coated paper by consistently performing a papermaking process, a coating process, and a flattening process.

BACKGROUND ART

As visualization and the tendency of multimedia have progressed in recent years, the needs for high quality, such as visualization or color, of printed matters having been widely used as media of publication, advertisement, and publicity have been rapidly increased. The change of the demands for uncoated printing paper in the related art to coated printing paper has been increased in accordance with these changes of user's needs, so that the demands for the coated printing paper has been rapidly increased.

In addition, since printing has been performed on the front and back surfaces of the coated printing paper in the past, there have been demands for coated paper that has the same quality, such as, glossiness, smoothness, and whiteness, on the front and back surfaces thereof. On the other hand, there has been also increased needs for separately using the front and back surfaces where designs having high visual quality are printed using four colors on the front surface of a published matter or throwaway and subsidiary designs are printed only using one or two colors on the back surface thereof in order to reduce cost.

In addition, requests for qualities of handling ability of printing paper and running stability on a printing machine, which correspond to improvement of workability or efficiency in a printing process, have become hard to be satisfied.

In response to the requests for qualities, the width and operating speed of a paper machine have been increased in the paper making industry for the purpose of labor saving and the reduction of manufacturing cost.

There are tendencies of the reduction of the metric weight of base paper, bipolar division between fine coating paper and coated paper having a large amount of a coating material, and differentiation of qualities on the front and back surfaces in coping with a request for quality of coated paper, labor saving, and reduction of manufacturing cost. Thus, there has been strongly required, in a manufacturing site, the development of manufacturing technique of coated paper which can satisfy the demand for the manufacture of the above-mentioned various kinds of coated paper taking an advantage of property for high speed operation.

Japanese Unexamined Patent Publication (Kokai) No. 05-51898 discloses a method of manufacturing multilayer coated paper that includes at least one or more overcoating layers formed on a support on which an undercoating layer is formed. In the method, the one or more overcoating layers are formed by blade coating and a surface treatment is performed on the surface of a coating layer by rigid surface-roughening roll before the blade coating is performed so that the surface of the coating layer has a surface roughness (Rmax) in the range of 8 to 30 μm defined in JIS B 0651. This document discloses as follows: a size press coater, a bar coater, an air knife coater, a roll coater, a rod blade coater, a doctor blade coater, and the like are used as a coating device in the method of manufacturing coated paper that coats the base paper with a coating solution containing a pigment and an adhesive as main ingredients, dries the paper, and finishes the paper. One coater, several same coaters, or different coaters of these coating devices are appropriately combined and used according to the quality design of a final product, the intended purpose of the product, and the use thereof so as to perform single-layer coating or multilayer coating.

However, coating facilities capable of being used to manufacture the coated paper are merely enumerated, which is the modification of the related art. Even though various coating facilities are used, the selective combination and arrangement of the coating facilities, and the cooperation with other facilities are not described and suggested. Further, since operability and productivity are not improved in a coated paper manufacturing site on a so-called on-machine where various kinds of coated paper are produced by a paper machine for consistently performing a papermaking process, a coating process, and a flattening process, a fundamental countermeasure is not obtained.

Accordingly, as a method to solve the above-mentioned problems, the present applicant has already proposed a method of manufacture coated paper through the combination of a roll coater coating facility and a blade coater coating facility in Japanese Patent Application No. 2005-179111 (published in Japanese Unexamined Patent Publication (Kokai) 2007-31925).

According to Japanese Patent Application No. 2005-179111 (published in Japanese Unexamined Patent Publication (Kokai) 2007-31925) various kinds of coated paper could be easily manufactured through the selectively use of the roll coater coating facility and the blade coater coating facility. In this case, before coated paper reaches a flattening facility from a roll coater coating facility, the moisture percentage of the coated paper needs to be in a predetermined range. However, if a blade coater coating facility for forming a coating layer on the surface of the base paper and a blade coater coating facility for forming a coating layer on the back surface of the base paper are provided in a post-process of the roll coater coating facility, a distance gets longer between the roll coater coating facility where the coating layer is formed and the flattening facility where the paper is fed from the coating facility. Accordingly, it may be difficult to make the moisture percentage of the coated paper be in a predetermined range. For this reason, the reduction of an ununiformed coating layer in a flattening treatment performed by the flattening facility has been required, and the contamination of a feeding line and a paper break trouble caused by contamination have been required to be suppressed.

DISCLOSURE OF THE INVENTION

Problems to be solved by the Invention

Accordingly, an object of the present invention is to provide a method of manufacturing coated paper, in which stability of quality of paper obtained by the flattening process can be improved by controlling a moisture percentage before the flattening process so as to be stable in a predetermined range while a roll coater coating facility and two coating facilities of which coating methods are different from that of the roll coater coating facility are used. Further, another object of the present invention is to provide a method of manufacturing coated paper, in which production efficiency can be improved by preventing the contamination of a feed line that is caused by getting longer of the feeding line after a coating layer is formed by a roll coater coating facility and by preventing a paper break trouble that is caused by the necessity of paper feeding under high contamination or high moisture percentage. Still another object of the present invention is to provide a method of manufacturing coated paper, in which paper feeding workability during paper break can be improved by arranging combined coating facilities having different coating methods as means for forming a coating layer on at least one surface of base paper so that the proper coating facility can be selected.

Means for Solving the Problems

The present invention for solving the above-mentioned problems is as follows.

- A method of manufacturing coated paper that consistently performs a papermaking process, a coating process, and a flattening process, wherein
  - a coating facility is formed of a combination of a roll coater coating facility and first and second coating facilities of which coating methods are different from that of the roll coater coating facility,
  - the roll coater coating facility uses a facility that is provided between the first and second coating facilities, and
  - the coating is performed by selecting one of the roll coater coating facility and the first and second coating facilities of which coating methods are different from that of the roll coater coating facility.
- In the above-described method of manufacturing coated paper according to the present invention, a gate roll coater, a rod metering size press facility, or a two-roll size press is provided between a press part of the papermaking process and the first coating facility.
- In the above-described method of manufacturing coated paper according
- the present invention, the paper web coated by the roll coater facility bypasses the second coating facility and is fed to the flattening facility.
- In the above-described method of manufacturing coated paper according to
- the present invention, each of the first and second coating facilities is a blade coater coating facility.

Operational Effect

The invention disclosed in each claim will be described in detail.

As well known, examples of the coating facility include a size press, a calender size, a wire bar, an air knife coater, a roll coater (such as a gate roll coater, a coating method of transferring a coating material by using a roll), a blade coater (such as a billblade coater, a method of forming a coating layer by scraping a coating material with a blade), a spray, and the like. A facility using a roll coater is generally used in Europe in order to preferentially ensure production efficiency, and a facility using a blade coater is generally used in Japan in order to preferentially ensure quality.

However, there has not been known an on-machine coating facility proposed in the present invention where several coating facilities having different coating methods are provided as means for forming a coating layer and a flattening facility is also provided. Further, it seems that there has been no method of manufacturing coated paper wherein a coating facility is formed of a combination of a roll coater coating facility and two coating facilities of which coating methods are different from that of the roll coater coating facility for selecting the facility as needed.

The manufacture of coated paper using a roll coater or a blade coater has been widely performed. However, the combination of coating facilities having different coating methods, for example, the combination of a roll coater and a blade coater causes the configuration of facilities to be complicated, and various kinds of knowledge are required in terms of maintenance. For this reason, it is thought that the combination thereof is not employed.

The scope of the present invention will be described below with reference to a preferred example of the coating facility where a roll coater and blade coaters of which coating methods are different from that of the roll coater are combined.

An advantage of a coated paper manufacturing facility including a blade coater is to produce coated paper having a large amount of a coating material. However, when fine coated paper is produced, it is difficult to produce a uniform coating layer. Blade coating is a method of scraping a coating solution on base paper. Accordingly, if the amount of the coating solution is very small, it is thought that the base paper from which the coating material is scraped is apt to be exposed.

Meanwhile, a coating layer is transferred onto the surface of base paper in a coated paper manufacturing facility including a roll coater. Accordingly, since the coating layer covers the surface of the base paper, it is possible to cover the surface of the base paper with the coating layer even though the coating layer is thin. Therefore, it can be stated that an advantage of the coated paper manufacturing facility including a roll coater is to produce fine coated paper. On the other hand, when the coated paper of which the amount of a material coated on one surface exceeds 10 g/m$^2$ is intended to be manufactured, the coating layer, which is transferred from the surface of the roll to the surface of the base paper, should be thick and due to flowablity of coating solution in high speed rotation and due to remaining of coating material on a roll surface when the coating material is transferred onto the paper, it is actually difficult to coat a large amount of coating material and it is also difficult to obtain a uniform coated surface. Thus, there is a problem where paper quality capable of satisfying users cannot be attained.

The present invention provides a coating method capable of multifariously coping with the production of various kinds of coated paper that has been particularly required in recent years.

When the roll coating and the blade coating are roughly compared with each other, relative merits therebetween become apparent from a correlation of the amount of a coating material coated on one surface. That is, if the amount of the coating material is 8 g/m$^2$ or more, coatability and smoothness are superior in the blade coating. In contrast, since the surface of a coating layer is apt to become concave and convex due to the concavity and convexity of the surface of the base paper in the roll coating, smoothness is inferior in the roll coating. Meanwhile, if the amount of the coating material is 6 g/m$^2$ or less, a coating material is caught in a concave portion of the base paper in the blade coating and a convex portion of the base paper is exposed, so that coatability is inferior. In contrast, in the case of the roll coating, coatability is superior.

Even though the amount of the coating material is 6 g/m$^2$ or less, that is, small, if clay, which has a high aspect ratio so as to obtain high coatability or gloss as a pigment, for example, delaminated clay (clay having laminated crystal structure) is used, the viscosity of the coating material is increased during the high speed coating. Therefore, the blade coating is more suitable.

If the amount of the coating material becomes 8 g/M$^2$ or more in the roll coating, it is difficult to control a profile in a width direction, a so-called orange peel pattern is formed, and surface appearance or an inking property becomes inferior. In contrast, the above-mentioned problems do not generally occur in the blade coating.

For example, high concentration coating where the concentration of the coating material is 65% or more can be performed in the blade coating, and the concentration of the coating material does need to be 56% or less in the roll coating. Accordingly, energy cost required for drying 1 kg of paper in the blade coating is smaller.

As described above, the coating methods of the roll coater coating and the blade coater coating are different in properties from each other.

When coated paper is manufactured, in foreign countries and Japan, there have been known an off-machine coater where a paper machine and a coating machine are separately provided and an on-machine coater where a coating machine is assembled into a paper machine.

In the case of the off-machine coater, paper generally passes through a size press in paper-making.

In particular, in a coating facility using an off-machine, coated base paper having low basis weight has a serious problem of paper break during the splice of an automatic splicer. The automatic splicer is a facility that connects paper without stopping the coater to improve production efficiency. Since being formed between base paper and base paper by adhesive means such as an adhesive tape, a connected portion of paper forms a convex portion. Accordingly, paper break hardly occurs at a coating speed less than 1000 m/min. However, if a coating speed exceeds 1000 m/min, particularly, 1300 m/min, paper break is apt to occur due to small difference of synchronization speed of winding rotation and due to a touch of a doctor blade edge to the connected portion of paper.

Measures for increasing the tensile strength of the base paper may be employed in order to suppress paper break. However, a tensile strength (MD) of at least 3.0 kN/m or more is required in the present inventor's opinion. Measures for adding a large amount of a paper strength-enhancing agent is required in the case of base paper having low metric weight where waste paper having low tensile strength is mixed at a high ratio. For this reason, it is not possible to avoid the significant increase of cost.

Since an automatic splicer does not need to be used in the case of the coating using the on-machine, it is possible to also set the strength of the base paper to a low value.

However, under the present circumstances, an operating speed (which is not a design speed) is about 1200 m/min even if being high. A tensile strength (MD) of 2.6 kN/m or more is required in order to obtain a higher papermaking speed (operating speed) exceeding 1300 m/min. For this reason, in the case of the coating using the on-machine, particularly, when waste paper is mixed at a high ratio, like the off-machine, measures for containing a paper strength-enhancing agent is required. For this reason, it is not possible to avoid the increase of cost.

In the base paper of recent years where recycled pulp is mixed at a high ratio, unlike the base paper that contains virgin pulp as a main ingredient, the decrease of tensile strength thereof or the mixing of foreign substances therein are significant. For this reason, if coating is intended to be performed with a basis weight of base paper in the range of about 30 to 45 g/m$^2$, at a speed exceeding 1000 m/min, particularly, at a speed exceeding 1300 m/min, a problem of paper break always occurs.

The paper break in the blade coater is apt to occur due to the pressing pressure of a blade, and particularly, the paper break in the on-machine makes a series of facilities from the paper making machine to the coating facility be stopped, which causes large production loss and the significant deterioration of production efficiency. For this reason, under the present circumstances, coated paper having low metric weight is generally manufactured by the coating using the off-machine.

The present applicant repeatedly studies a coating method that can quickly cope with the quality required by a user and produce various kinds of coated paper by a series of facilities. As a result, the present applicant found out a method of manufacturing coated paper where several coating facilities having different coating methods are provided as means for forming a coating layer, and a roll coater coating facility and two coating facilities of which coating methods are different from that of the roll coater coating facility are combined according to the required quality of the coated paper.

Most preferably, a blade coater coating facility is provided as a coating facility that has a coating method different from that of the roll coater coating facility, the roll coater coating facility is provided between the blade coater coating facility corresponding to one surface of the base paper and the blade coater coating facility corresponding to the other surface of the base paper, and the coated paper can be manufactured by using the roll coater coating facility and/or the blade coater coating facilities of the coating facility, according to the required quality of the coated paper.

Further, it was found out a technique for providing coated paper having low metric weight and high quality printing appearance where waste paper is mixed at a high ratio with high production efficiency, by flattening the surface of the coating layer by a flattening facility, particularly, a flattening facility where a metal roll and an elastic roll are combined, thereby completing the present invention.

According to the present invention, it is possible to continuously perform a coating process through a process for applying an undercoating solution such as starch on a paper web that is obtained by performing papermaking and drying, by a size press or a process for performing flattening by a facility used for a pre-coating, such as a pre-calender.

The coating process of the present invention is performed as follows.

In the method, the roll coater coating facility and two coating facilities of which coating methods are different from that of the roll coater coating facility are combined, and the roll coater coating facility is provided between the two coating facilities.

After that, a flattening process is performed by a hot soft calender that is formed of the combination of an elastic roll and a metal roll for performing flattening, for example, having plural stages with at least two nips.

Which one of the coating processes is used may be determined on one line in consideration of the metric weight of base paper, whether waste paper is mixed, and the amount of the mixed waste paper, the amount of a coating material, a line speed, the metric weight of a product, and quality such as required glossiness and smoothness.

Accordingly, on one line, it is possible to commonly manufacture light fine coated paper, fine coated paper, A3 coated paper, A2 coated paper, and coated paper having different quality on the front and back surfaces thereof, if necessary.

The distinguishment of them is not clear in the art. However, for example, a blade coater may be used for A3 coated paper of 64.0 g/m$^2$ or 60.2 g/m$^2$ or more, a blade coater or a roll coater may be used for fine coated paper of 58.0 g/m$^2$ or 54.2 g/m$^2$, and a roll coater may be used for light fine coated paper of 51.2 g/m$^2$ or less.

As a specific example, when 10% or more of recycled pulp used as raw material pulp is mixed to a base paper, it is possible to manufacture coated paper or fine coated paper, which has a metric weight of base paper in the range of 28 to 80 g/m$^2$ (particularly, 35 to 48 g/m$^2$), a metric weight of a product in the range of 30 to 103 g/m$^2$ (particularly, 38 to 64 g/m$^2$) , the amount of a material coated on one surface in the range of 2 to 23 g/m$^2$ (particularly, 4 to 9 g/m$^2$), by continuously and consistently performing processes from a papermaking process to a winding process at a papermaking speed of 1300 m/min or more, for example, at a high average papermaking speed in the range of 1600 to 1800 m/min.

In the present invention, a pre-coating process for applying an undercoating solution such as starch by a gate roll coater, a rod metering size press facility, or a two-roll size press may be combined with an on-machine coater. Further, a process for performing flattening by the pre-calender may be combined with an on-machine coater.

If an undercoating agent such as starch is coated by a size press, it is possible to increase paper stiffness and paper strength. Further, even if the metric weight of the base paper is reduced or waste paper is mixed at a high ratio (particularly, in the case of blade coating), it is possible to prevent paper break, to suppress the protrusion of foreign substances by coating, and to contribute to the smoothing of a coating solution that is applied later.

Substantially, it is preferable that a flattening process be performed by a pre-calender. The pre-calender not only contributes to the smoothing but also contributes to make the coated profile in the width direction be uniform. That is, the pre-calender functions to make the surface of paper, on which an undercoating solution such as starch is applied, be uniform. In particular, if the intended width of paper is 7000 mm or more, break of the coated profile is increased in the width direction. Meanwhile, if a flattening process is performed by the pre-calender, it is possible to facilitate the smoothing. In particular, subsequently, if the coating of 8 g/m$^2$ or more is performed by a roll coater, it is difficult to control the profile in the width direction of the roll coater. Meanwhile, if a pre-calender is employed, it is possible to make the profile in the width direction be uniform. Further, if being performed in order to make the surface in the width direction be uniform, blade coating contributes to the uniformity of touch of a blade, thereby contributing to the prevention of paper break.

It is preferable that a flattening process be performed by a hot soft calendar, which is used as a flattening facility, formed of the combination of an elastic roll and a metal roll having plural stages with at least two nips. In particular, a 6-stage multinip calendar is preferable, an 8-stage multinip calendar (seven nips) is more preferable, and a 10-stage multinip calender is optimum.

In general, as the amount of a coating material is reduced, it becomes difficult to ensure smoothness and glossiness. In contrast, if a process for performing the flattening is provided, it is possible to obtain coated paper having a desired glossiness of 55% or more, particularly, 60% or more even though the amount of the coating material is 7 g/m$^2$ or less, particularly, 6 g/m$^2$ or less, the metric weight of a product is less than 54.2 g/m$^2$, and a metric weight of base paper is 45.0 g/m$^2$ or less.

A fact that a multinip calender (hot soft calender) is provided is publicly known, but the multinip calendar is hardly employed. Furthermore, the combination of the undercoating using a size press and the pre-calender is the first thing about any one of the on-machine coater and the off-machine coater.

The combination of them according to the present invention allows coated paper, which has the amount of the coating material exceeding 10 g/m$^2$ as well as light fine coated paper of 51.2 g/m$^2$ or less to be manufactured in terms of high smoothness and high glossiness.

The most preferred method according to the present invention is a method using the configuration where a coating facility using a roll coater is provided between the coating facilities using blade coaters that form coating layers on front and back surfaces.

As for the manufacture of coated paper on an on-machine, a moisture percentage of paper is a very important control index, and the variation of the moisture percentage affects paper break or most paper qualities, such as whiteness, glossiness, and bulk.

The moisture percentage of coated paper in the blade coater coating facility is about 4.5% at an inlet of the blade coater coating facility and about 11% at an outlet of the blade coater coating facility. Meanwhile, the moisture percentage of coated paper in the roll coater coating facility is about 4.5% at an inlet of the roll coater coating facility and about 18% at an outlet of the roll coater coating facility. That is, the moisture percentage of the roll coater coating facility is very higher than that of the blade coater coating facility. Therefore, the paper break in the coated paper facility generally occurs on the rear side of the roll coater coating facility.

The present applicant has found out the following method and already filed an application thereof (hereinafter, this is referred to as a "comparative example"). In the method of manufacturing multiple (various kinds of) coated paper, which is the same target as that of the present invention, two blade coater coating facilities for one and the other surfaces are provided at a post-process of the roll coater coating facility, and coating having a small amount of the coating material and coating having a large amount of the coating material are selectively performed according to need in order to manufacture various kinds of coated paper.

However, in the method of manufacturing coated paper according to the comparative example, when a coating layer is formed by a roll coater, facilities are arranged so that paper passes through two, that is, first and second blade coater coating facilities. Accordingly, a length (that is, time), taken for the paper to be fed to the flattening facility from the roll coater coating facility, is long. For this reason, since the decrease or variation of the moisture percentage might occur in a feeding process, it was difficult to stably keep the moisture percentage at about 8% that was required to perform a flattening process.

In order to set the moisture percentage of paper in a predetermined range when paper enters the flattening facility, the decrease of the moisture percentage needs to be anticipated in a process through the first and second blade coater coating facilities (including also a drying zone) and paper needs to be fed while the moisture percentage is high. For this reason, there are problems to be solved in that the contamination of the feeding line is caused thereby a feed trouble such as paper break is occurred.

Meanwhile, in the method of manufacturing multiple coated papers, a roll coater coating facility may be provided at the post-process of the two blade coater coating facilities that form coating layers on front and back surfaces. However, a drying facility needs to be newly provided on the rear side of the roll coater coating facility, so that cost is increased and the size of the facility is increased. For this reason, there is a problem in that a large facility space is required.

In contrast, according to the present invention, the roll coater coating facility is provided between the two coating facilities. Accordingly, facilities are arranged so that paper passes through only one, that is, the second blade coater coating facility after the coating layer is formed by the roll coater coating facility. Accordingly, a length (that is, time-taken for the paper to be fed to the flattening facility, is short. For this reason, the moisture percentage before the flattening process is stably kept in a predetermined range, so that it is possible to improve the stability of quality in the flattening process.

Further, since the feeding line is shortened after the coating layer is formed by the roll coater coating facility, paper does not need to be fed for a long time after the roll coater coating while the moisture percentage is high. Thus, it is possible to prevent the contamination of the feeding line or paper break and to significantly improve production efficiency.

Effects of the Invention

According to the present invention, while a roll coater coating facility and two coating facilities of which coating methods are different from that of the roll coater coating facility are used, a moisture percentage before a flattening process is stably kept in a predetermined range, so that it is possible to improve the stability of quality in the flattening process. Further, it is possible to prevent the contamination of the feed line that is caused by the increase of the length of a feeding line after a coating layer is formed by the roll coater coating facility, and a paper break trouble that is caused by the necessity of paper feeding under high contamination or high moisture percentage, thereby improving production efficiency. Furthermore, it is possible to improve paper feeding workability during paper break by providing combined coating facilities having different coating methods as means for forming a coating layer on at least one surface of base paper so that the proper coating facility can be selected.

EXPLANATIONS OF LETTERS OR NUMERALS

Figure 1:
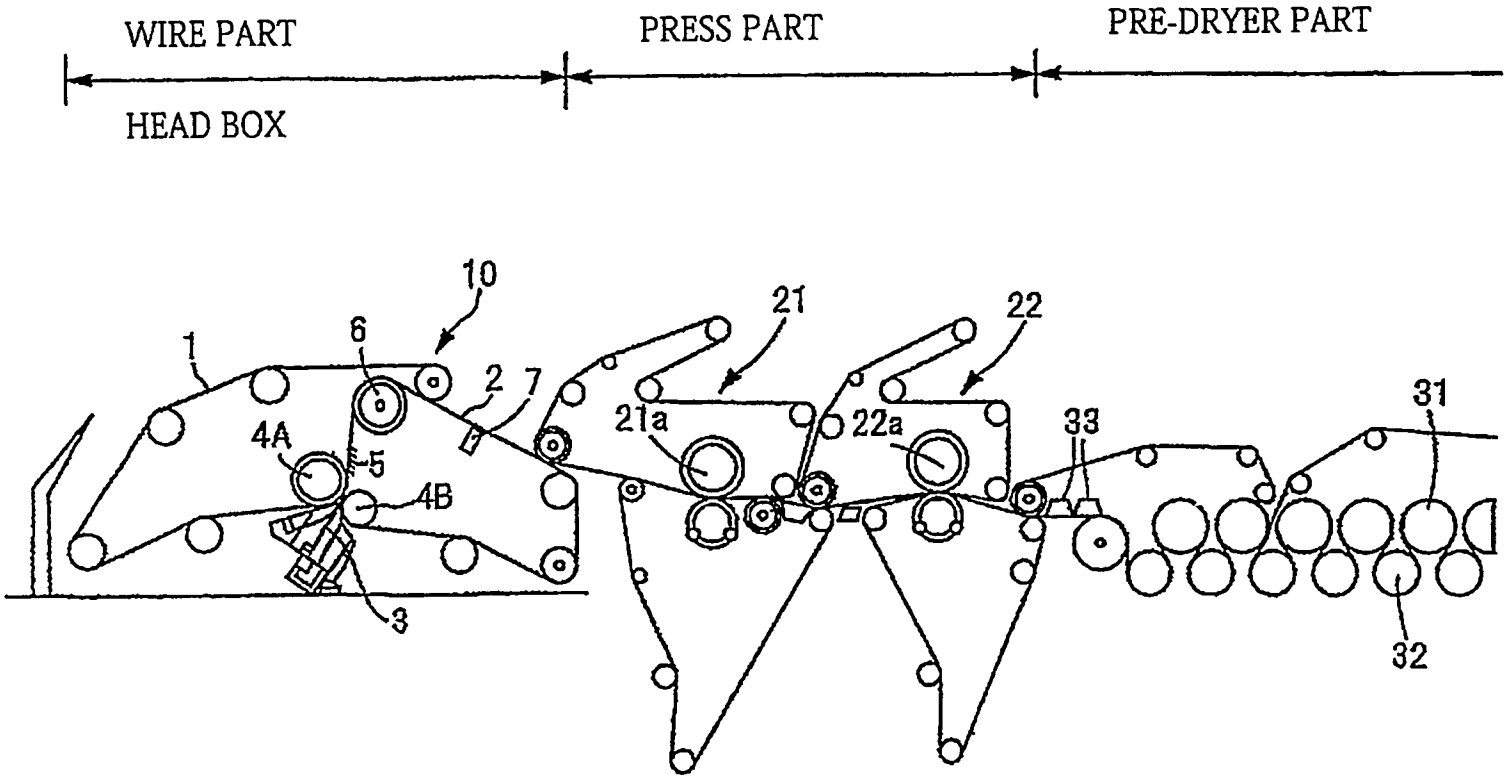
FIG. 1 is a schematic view showing a first zone of the exemplified configuration of a paper machine.
Figure 2:
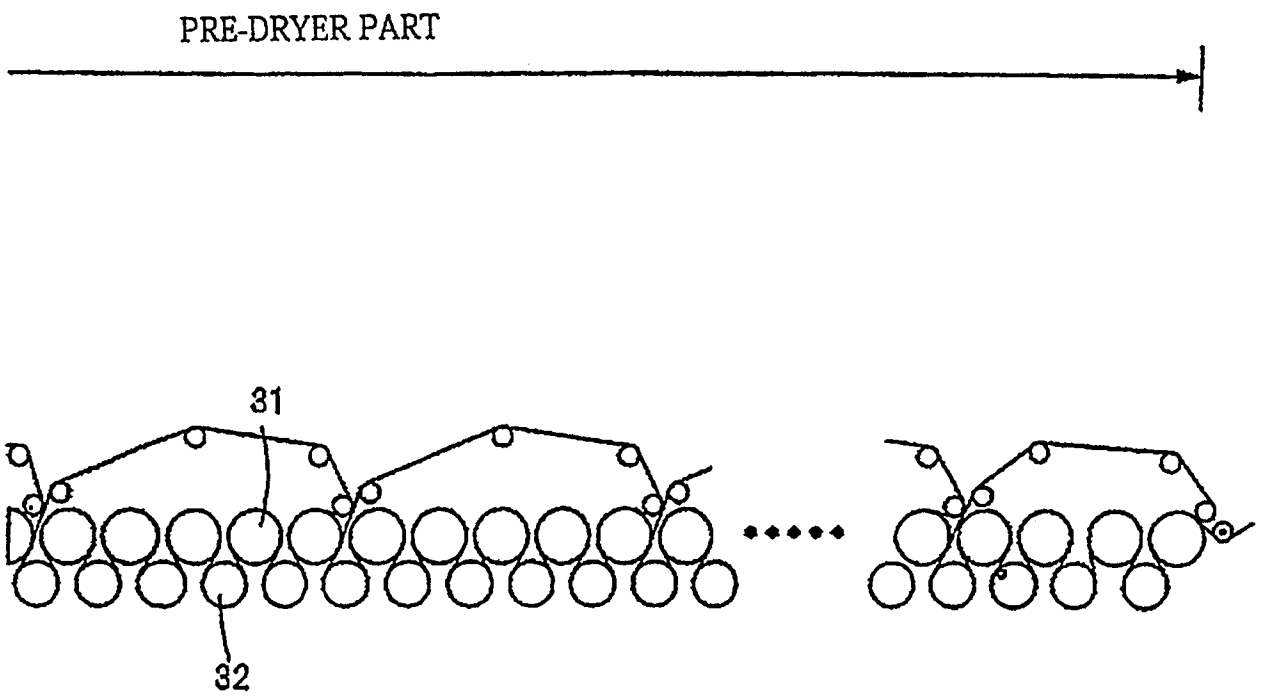
FIG. 2 is a schematic view showing a second zone of the exemplified configuration of the paper machine.
Figure 3:
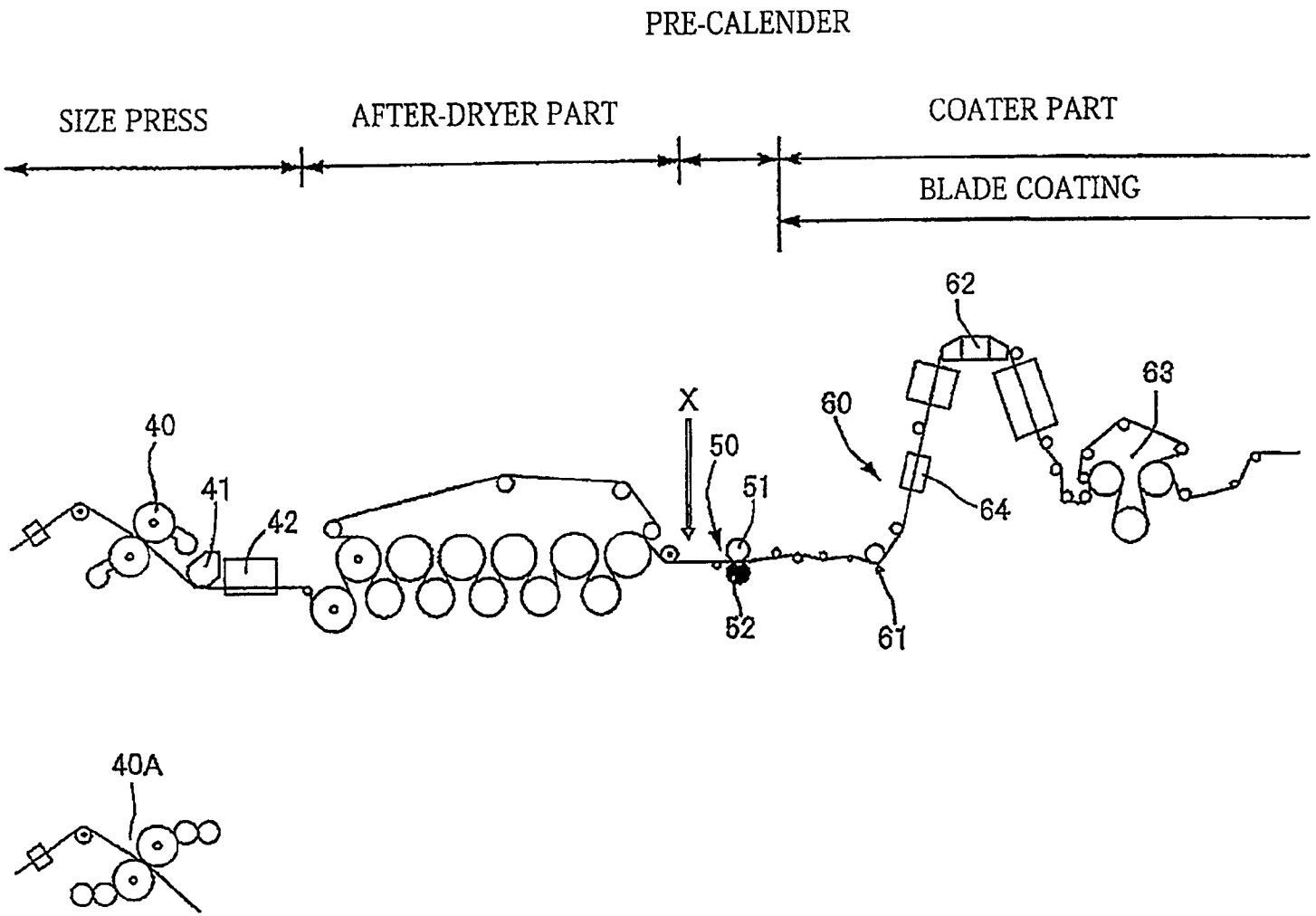
FIG. 3 is a schematic view showing a third zone of the exemplified configuration of the paper machine.
Figure 4:
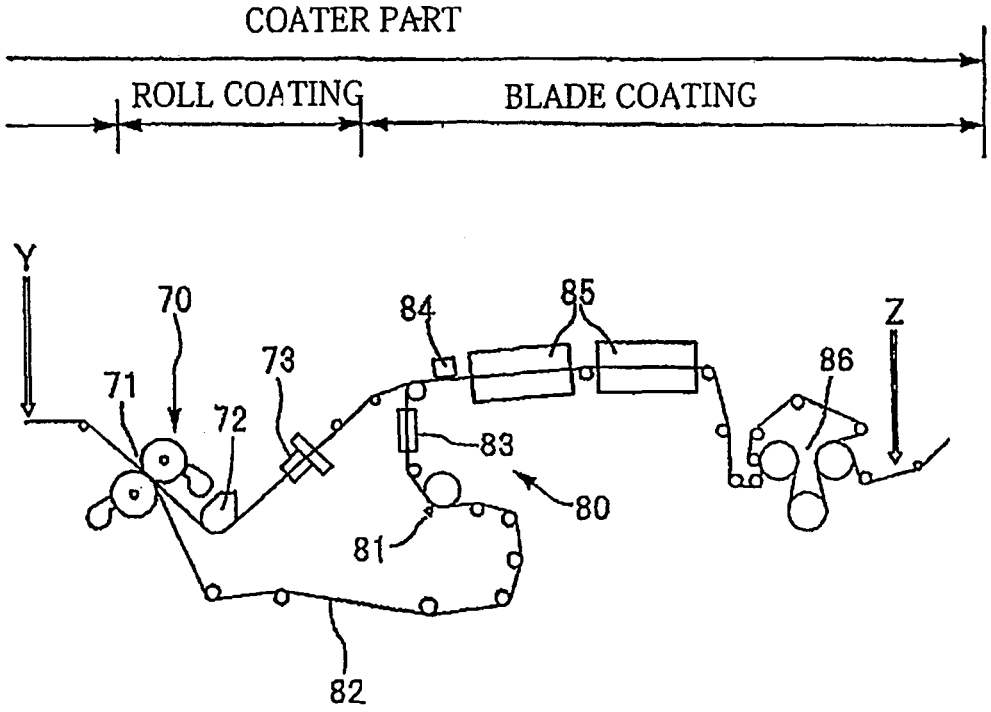
FIG. 4 is a schematic view showing a fourth zone of the exemplified configuration of the paper machine.

1 first wire
2 second wire
3 head box
5 blade
10 twin wire former
21 first press
22 second press
40 size press
41 air turn bar
50 pre-calender
51 metal roll
52 elastic roll
60 first blade coating facility
70 roll coater coating facility
80 second blade coating facility
90 on-machine calender
M metal roll
D elastic roll
100 reel

BEST MODE FOR CARRYING OUT THE INVENTION

The present invention will be described in detail below with reference to an embodiment.

The intention of the present invention is to continuously and consistently perform papermaking to winding so as to manufacture coated paper or fine coated paper, which has, for example, a metric weight of base paper in the range of 28 to 80 g/m$^2$ (particularly, 39 to 48 g/m$^2$) and a metric weight of a product in the range of 40 to 105 g/m$^2$ (particularly, 54 to 64 g/m$^2$), by high speed papermaking where an operating speed exceed 1300 m/min or more, particularly, at high speed where an operating speed is 1550 m/min or more or in the range of 1600 to 1800 m/min.

First, the general summary of an embodiment of the present invention will be described with reference to FIGS. 1 to 5.

<Paper Machine and Facilities used for Pre-Coating Processes>

A paper machine, which makes paper by a gap type twin wire former 10 for forming a layer of paper by discharging paper stock J from a head box 3, is provided between two wires (first and second wires 1 and 2), which form loops, respectively. The paper stock J is discharged to a gap between the wires at a position between a suction (forming) roll 4A and an opposite roll 4B in a wire part, so that a layer of paper is formed. The layer of paper is dehydrated up to e.g., 80% of moisture while passing the suction (forming) roll 4A, a blade 5, the suction couch roll 6, a suction box 7, and the like.

In the embodiment shown in drawings, both roll means and blade dehydration means have been used as a dehydration mechanism. Preferably, both of them may be used, but only one of them may be used.

Figure 10:
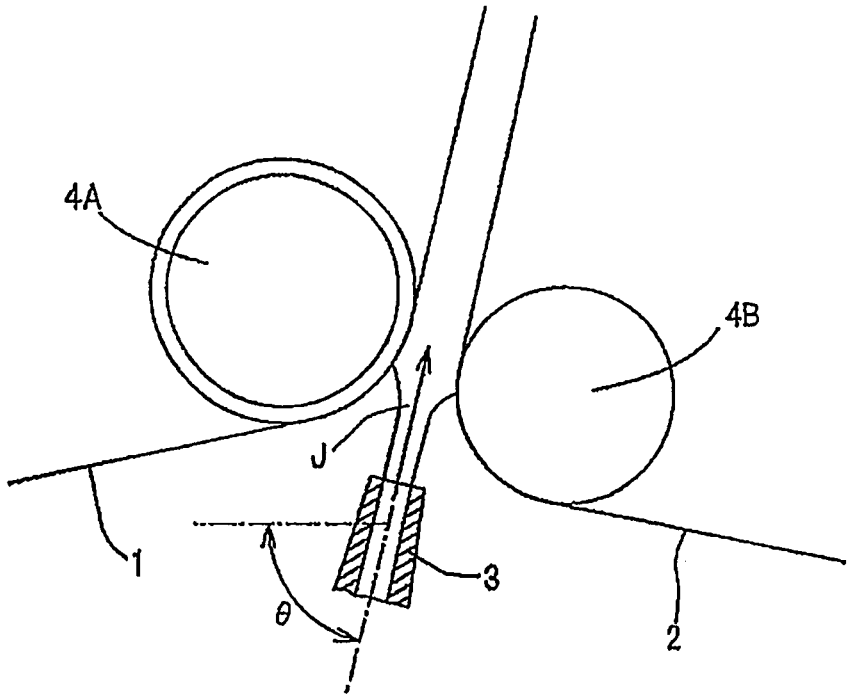
FIG. 10 is an enlarged schematic view of a head box.

The head box 3 is disposed upward while being vertical or inclined on the downstream side. A discharge angle θ, which is formed between a horizontal line and a line corresponding to the discharge direction of the paper stock as enlarged in FIG. 10, is preferably in the range of 50° to 90°. Under the high speed papermaking that is intended by the present invention, the head box is preferably an upward head box, which is less affected by fiber weight, in terms of the balance of the formation, the axial strength in a Z direction, the difference between front and back surfaces, a fiber orientation angle, and the like. If the head box is horizontally disposed in the gap type twin wire former, it is difficult to obtain characteristics that are to be obtained under the high speed papermaking.

The layer of paper in the wire part is sent to a press part and further dehydrated. First and second presses 21 and 22 of the press part of the embodiment include shoe presses 21*a* and 22*a*, respectively, and nip the layer of paper straight without open drawing in order to prevent paper break. Further, double felt is used as the first press 21 and a belt is employed on the bottom side of the second press 22. Because of the above configuration, rewetting is prevented, and the dehydration is also improved. If the basis weight is increased to 60 g/m$^2$ or more and the amount of removed moisture is increased, it is preferable that the double felt be used.

Wet paper, which is dehydrated in the press part so as to have about 50% of moisture, is sent to a single deck type pre-dryer part and to be dried. The pre-dryer part shown in the drawing is a no open drawing type single deck dryer. The upper portion of the pre-dryer part is composed of an appropriate number of heating rolls 31, and the lower portion thereof is composed of an appropriate number of vacuum rolls 32. The single deck type dryer efficiently performs drying under the high speed papermaking of the present invention where an operating speed is 1300 m/min or more, while paper break is suppressed and bulk is not decreased. Accordingly, the single deck type dryer is superior in terms of quality and operation. It may be considered that drying is performed by a double deck type dryer, but there are problems in terms of canvas marks under the high speed papermaking operability, such as paper break, wrinkles, and paper connection under the high speed drying.

It is preferable that groups are minutely divided for the drawing adjustment at the beginning of drying and a suction box 33 is provided in order to improve paper feeding performance and sheet traveling performance.

A sizing agent such as starch, a surface treatment agent such as a size pressing agent, or an undercoating solution such as a pigment coating solution, if necessary, is applied on both surfaces of a paper web, which have been dried by the pre-dryer part, by a size press 40 using film transfer (method) provided between the pre-dryer part and an after-dryer part. A gate roll coater 40A or a two-roll size press may be used as the size press 40 other than a rod metering size press coater shown in the drawing.

A starch derivative, such as a starch oxide, esterified starch, enzyme-modified starch, or etherified starch, and a natural adhesive, such as soy protein, yeast protein, or cellulose derivative, may be used as the above-mentioned undercoating solution other than the starch. Meanwhile, pigments may be added if necessary. Pigments for common coated paper, such as kaolin, clay, barium sulfate, light calcium carbonate, heavy calcium carbonate, aluminum hydroxide, satin white, titanium dioxide, calcium sulfite, zinc sulfate, and a plastic pigment, may be mixed as the pigments in accordance with the properties of the pigments. In addition, adhesives for common coated paper may be used as the adhesive. The adhesives include a synthetic resin adhesive such as alkali-no sensitive or alkali-sensitive synthetic resin emulsion that includes conjugated diene copolymer latex, such as a styrene-butadiene copolymer or a methyl methacrylate-butadiene copolymer, acryl polymer latex, such as a polymer or a copolymer of acryl and/or methacrylate ester, and vinyl acetate copolymer latex such as anethylene-vinyl acetate copolymer. Various auxiliary agents, such as a dispersant, a flow modifying agent, an anti-foaming agent, a dye, a lubricant, a water resistant agent, and a water retention agent, may be mixed if necessary.

An undercoating agent of the present invention is used for increasing stiffness, particularly, in the case of a fine coated paper product having low stiffness, whereby preventing troubles caused by high speed printing. It is preferable that the application thereof be performed using starch as a main ingredient, the application thereof be performed while the concentration of starch is in the range of 2.5 to 15.0%, and the amount of the applied undercoating agent be in the range of 1.0 to 5.0 g/m$^2$ on both surfaces.

A gate roll coater, a Sym-Sizer, a blade metering size press, or a rod metering size press may be used as the film transfer type application means. Particularly, the rod metering size press is preferable. If the rod metering size press coater is used, it is preferable that a rod having smooth surface be used in order to avoid the generation of streaks during the operation. If the diameter of the rod is set in the range of 15 to 50 mm, it is possible to obtain more preferable operability and quality. In the case of a rod of which the diameter is smaller than 15 mm, film forming ability deteriorates and the face shape thus tends to deteriorate. Since an effect is not changed in the case of a rod of which the diameter is larger than 50 mm, the diameter of the rod does not need to be particularly increased. A rod having grooves, a rod where a wire is wound, and the like may be used as the rod.

It is preferable that an air turn bar 41 and an auxiliary drying device 42 using an infrared ray be previously provided to prevent surface contamination from occurring in the after-dryer after the application of the undercoating solution. A sizing agent or a pigment coating solution is dried in the single deck after-dryer part shown in the drawing.

<Coating Facility>

After that, an adhesive and an aqueous coating solution, which contains a pigment (kaolin and the like) as a main ingredient, are coated in the coater part. In this case, since high quality coated paper having high smoothness and glossiness is required under the condition where the papermaking (operating) speed is 1300 m/min or more, the blade coating of an aqueous coating solution performed on both surfaces of the paper web is employed in terms of the quality of the coated paper. Further, the roll coating performed on both surfaces is also employed for fine coating.

Meanwhile, it is also preferable that the surface on which a sizing agent is applied be smoothed by a pre-calender 50 in order to ensure higher smoothness before the roll coating of the aqueous coating solution. The upper portion of the pre-calender 50 of this embodiment is composed of a metal roll 51, and the lower portion thereof is composed of an elastic roll 52. According to the operation condition in the pre-calender, it is preferable that a hot roll be used as the metal roll, for example, the temperature of the hot roll be in the range of 100 to 300° C., particularly, 150 to 250° C. and linear pressure be 50 KN/m. Metal rolls may be used as both rolls, and caliber control rolls may be used as the rolls to control the profile in a width direction.

In the coater part of the present invention, a roll coater coating facility 70, two coating facilities of which coating methods are different from that of the roll coater coating facility 70, that is, a first blade coating facility 60 and a second coating facility 80 are provided in the embodiment in the order of the first blade coating facility 60, the roll coater coating facility 70, and the second coating facility 80.

In more detail, a first blade coating machine 61 for a lower surface, a first gas type air dryer 62, and a first canvas dryer 63 are sequentially provided in the first blade coating facility 60. Preferably, a first infrared drying device 64, which can control temperature in the width direction, is provided at the subsequent side of the first blade coating machine 61 in order to prevent uneven drying in the width direction.

Further, a roll coater 71, which includes a gate roll coater and a rod metering size press, is provided in the roll coater coating facility 70. Furthermore, an infrared drying device 73, which can control temperature in the width direction, is provided at the subsequent side of an air turn bar 72 in order to prevent uneven drying in the width direction.

Meanwhile, a bypass passage 82 is provided on the output side of the roll coater 71, and a second infrared drying device 83 and a first blade coating machine 81 for an upper surface are provided on the bypass passage 82. Further, a second infrared drying device 84, second gas type air dryers 85, and a second canvas dryer 86 are sequentially provided on the rear side of a position where the flow from the roll coater 71 is joined.

<Flattening Facility and the Like>

An on-machine calender 90 composed of a hot soft calender is provided at the subsequent side of the coating facility, so that a calender process is performed. The calender 90 shown in the drawing is a one-stack type calender having seven nips, and is disposed so as to be inclined in a Janus type that is less affected by the own weight of the roll. Of course, the calender may be vertically disposed in an optical rod type.

The calender 90 influences the final smoothness and glossiness. Accordingly, various things need to be considered in terms of this and high speed papermaking.

Figure 5:
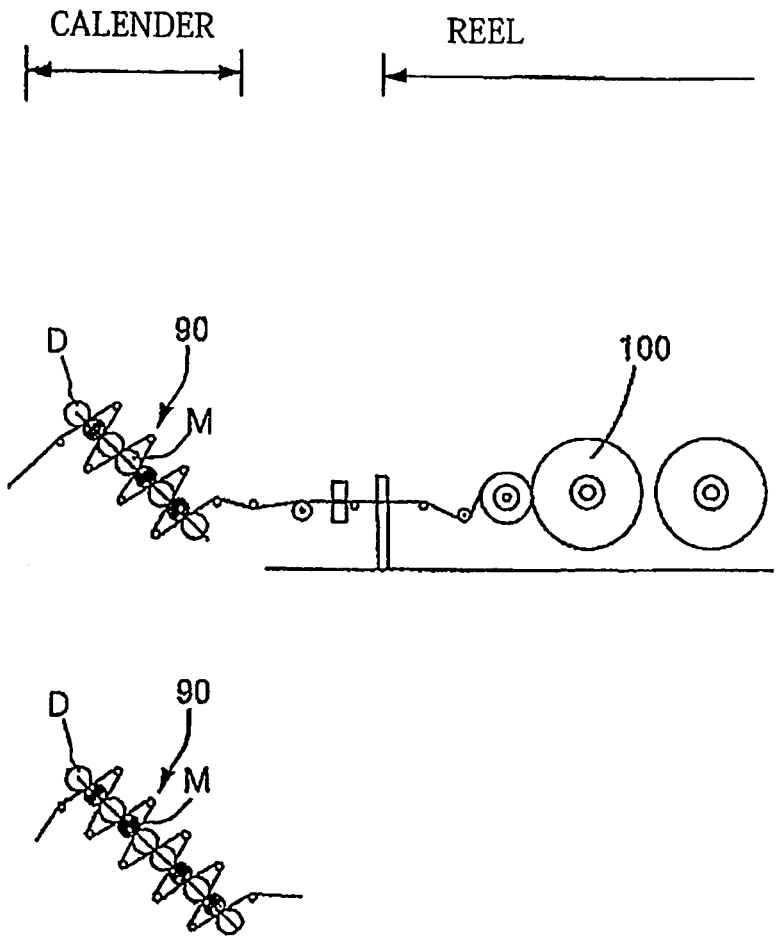
FIG. 5 is a schematic view showing a fifth zone of the exemplified configuration of the paper machine.

The number of the stages of the calender 90 is not limited as long as the calender has at least two nips. However, it is preferable that a flattening process be performed by a hot soft calender formed through the combination of an elastic roll D and a metal roll M having a plurality of stages. In particular, a multinip calender, more preferably, 6-stage, 8-stage, or 10-stage multinip calender is optimum. An example of a 10-stage multinip calender is shown in FIG. 5. In addition, a multinip calender, which can independently adjust nip pressure on all stages, is optimum.

Figure 7:
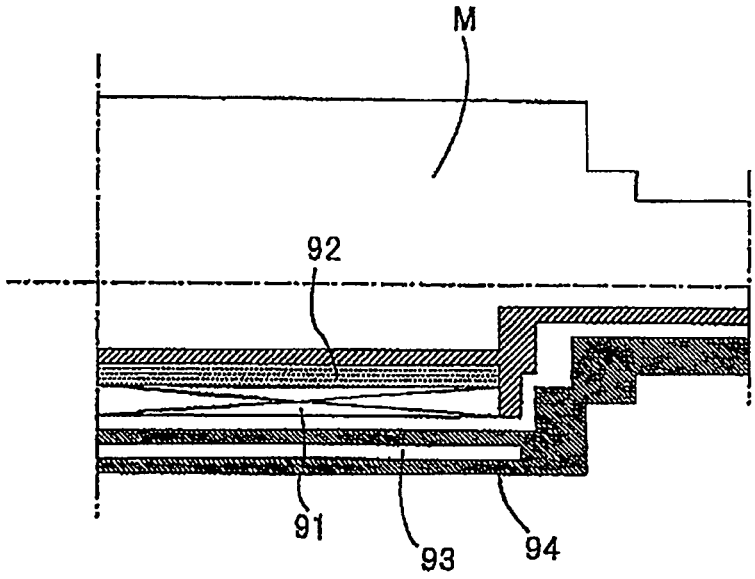
FIG. 7 is a schematic view showing a heating metal roll.
Figure 8:
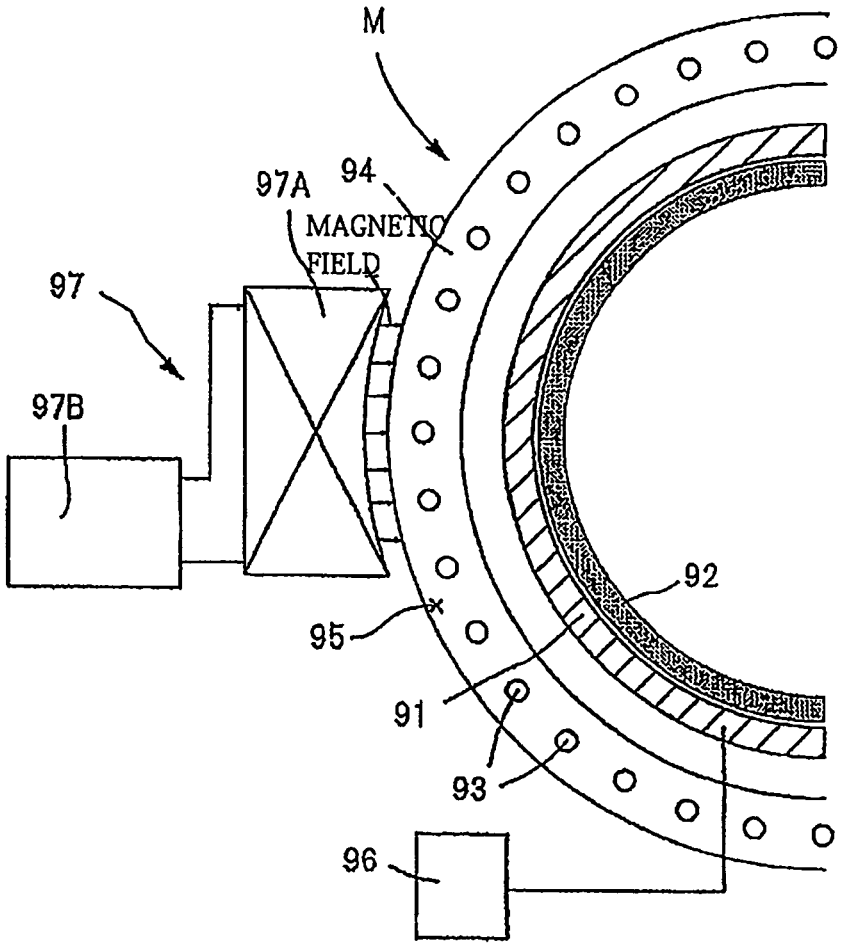
FIG. 8 is a schematic view showing an example of an internal heating device using electromagnetic induction.
Figure 9:
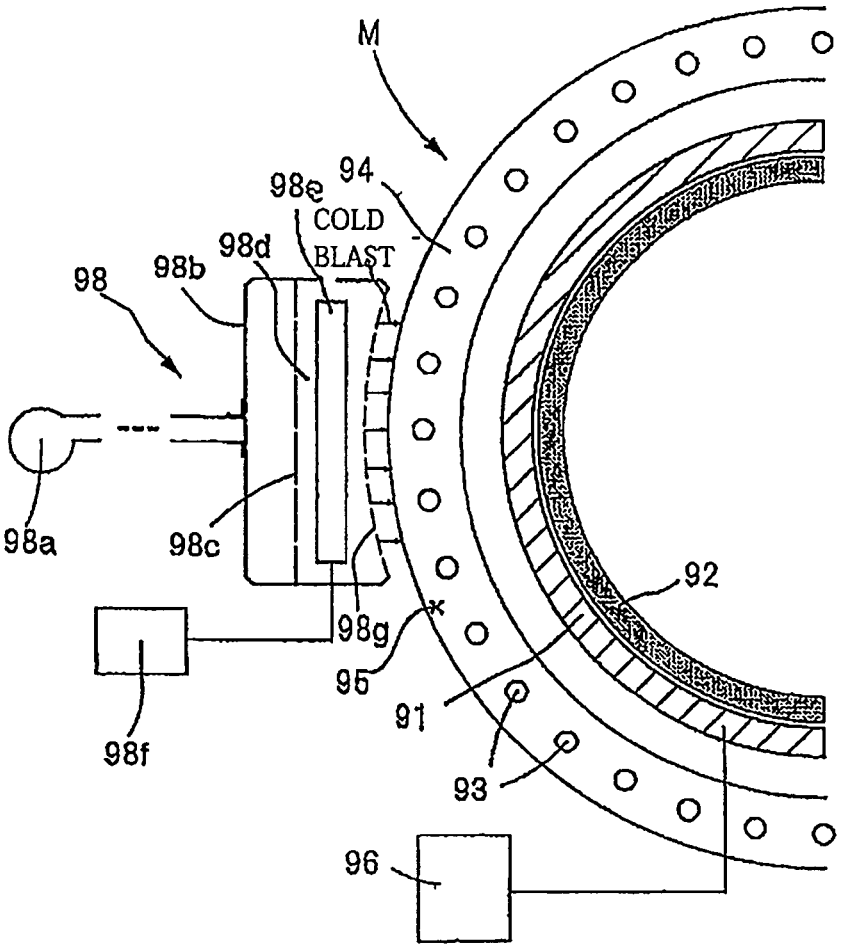
FIG. 9 is a schematic view showing an example of a cooling facility.

Meanwhile, the hot soft calender may make a heat carrier such as oil flow and heat the heat carrier. However, an upper limit of the surface temperature of the roll is about 180° C. in this case. In order to make paper at high speed, the metal roll M is provided with an internal heating device, which uses electromagnetic induction so as to locally control temperature in the width direction of the metal roll, as shown in FIGS. 7 to 9. It is preferable that a treatment be performed when the surface temperature of the metal roll M is 230° C. or more, particularly, in the range of 230 to 500° C. Specifically, an induction coil 71 is wound around an iron core 72 in a shell 74, and heats the heating medium that flowing through a jacket chamber 73.

A surface treatment is performed when the temperature of the metal roll M is in the range of 250° C. to 380° C., particularly, in the range that exceeds 300° C. and is 380° C. or less. A moisture percentage at an inlet of the flattening facility is preferably in the range of 4 to 10%, more preferably, in the range of 6 to 9%. It is possible to prevent the decrease of the bulk and to suppress the deterioration of opacity by preventing all layers of the paper from being crushed under as low nip pressure as possible. Therefore, it is possible to stably perform operation. So to speak, an extremely high temperature iron may be used for a short time.

As the control of the surface temperature of the metal roll, other than the above-mentioned method of circulating heated water or oil in the metal roll, a method using an "internal heating device using electromagnetic induction" is particularly superior against the high temperature treatment of the present invention. The device includes an induction coil that is wound around an iron core provided inside as a stationary component, generates magnetic flux on the coil by making alternating current flow through the induction coil so that induced current is induced in an outer shell (outer case) provided as a rotary component, and makes the outer shell (outer case) generate heat (self-heating or induction heating) by resistance heat. Further, according to the internal heating device using electromagnetic induction, the induction coil is divided (into, for example, 3 to 6 sections) in the width direction (the longitudinal direction of the roll itself) of the roll, and the amount of alternating current flowing through corresponding induction coil is controlled on the basis of a temperature signal that is transmitted from a temperature sensor provided in the shell. Therefore, it is possible to obtain an advantage of accurately controlling, particularly, the surface temperature of the roll in the width direction thereof.

In this case, particularly, if a plurality of 10 to 90 jacket passages extending in a longitudinal direction are provided in the shell at intervals in a circumferential direction, communicate with each other, and enclose a heat carrier therein, it is possible to obtain an advantage of absorbing heat caused by the self-heating of the shell and making the heat become uniform on the entire roll.

If the surface treatment is performed at high temperature in accordance with the present invention, not only the temperature of the surface portion of the paper but also the temperature of the inner layer portion thereof rises. As a result, not only the surface portion of the paper but also the all layers thereof is easily crushed, so that the bulk is decreased. However, if the paper is intended to be quickly fed while a treatment is performed at very high temperature, it is possible to reliably prevent heat from being transferred to the inner layer portion and to prevent the decrease of the bulk.

Meanwhile, as the surface temperature of the metal roll rises, stress is generated in the shell of the metal roll in a thickness direction. Accordingly, the roll profile tends to be broken, so that the controllability of the paper thickness profile deteriorates. Further, if the internal heating device using electromagnetic induction is used, it can be hardly said that the temperature responsiveness of the surface temperature of the metal roll per unit time is superior. For this reason, the temperature responsiveness in the width direction and the temperature controllability are inferior, which causes the deterioration of quality. Accordingly, it is preferable that at least one of an external heating device and a cooling facility be provided near the metal roll M. In this case, the external heating device uses electromagnetic induction so as to locally control temperature in the width direction of the roll, and the cooling facility can control cooling temperature in the width direction of the roll.

This will be described with reference to FIGS. 7 and 8. The metal roll M includes a shell 94, an induction coil 91, an iron core 92, a temperature sensor 95, an AC source 96, and jacket passages 93. An external heating device 97, which uses external electromagnetic induction so as to locally control temperature in the width direction of the metal roll M, is provided near the metal roll M, so that a high temperature nip zone of base paper is formed in each stage.

The external heating device 97 uses the principle of the electromagnetic induction heating. As shown in the drawings, the external heating device makes alternating current (for example, high frequency of 3 to 20 kHz) supplied from an AC source (inverter) 97B flow in a work coil 97A, generates a magnetic field, and generates eddy current on the surface portion of the shell 94, thereby being self-heated. It is preferable that a distance between the work coil 77A and the surface of the shell 94 be in the range of about 2 to 20 mm, particularly, 2 to 5 mm. Further, it is preferable that a unit work coil be inclined to cross an axis of the metal roll M in order to make the heating profile uniform. A zone control pitch in the width direction of the roll is in the range of about 75 to 150 mm, and the rated power may be in the range of 4 to 20 kW per zone.

As an example of the cooling facility 98 that can control cooling temperature in the width direction of the roll, as shown in FIG. 9, there is a device that sends air supplied from a fan 98*a* to a header 98*b*, sends the air into a temperature adjusting chamber 98*d* through an adjusting plate 98*c* having a communication hole, and cools a coil 98*e* provided in the temperature adjusting chamber 98*d* by a temperature adjusting means 98*f*, thereby controlling the temperature of air passing through a diffusion plate 98*g* that has small holes.

It is preferable that the nip pressure of the calender 90 be in the range of 200 KN/m to 450 KN/m, particularly, in the range of 300 KN/m to 450 KN/m. It is possible to manufacture mat type coated paper while gaps between the rolls are opened in the calender 90 except for one or two nips if necessary. However, if a flattening process is performed using the rolls corresponding to 6 to 12 stages, it is possible to obtain coated paper, which has white paper glossiness of 55% or more, particularly, 60% or more, even under high speed papermaking where an operating speed is 1300 m/min or more.

Paper smoothed by the calender 90 is finally wound around a reel 100, and winders (not shown) for completing winding for subdivision are provided at the rearmost portion of the machine.

Figure 6:
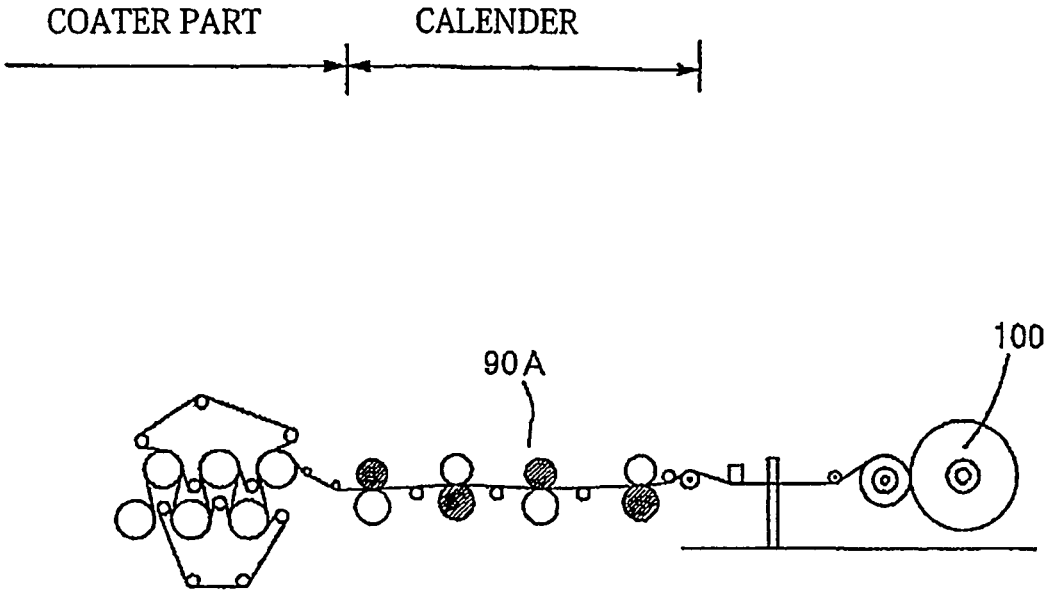
FIG. 6 is a schematic view showing the modification of the fifth zone of the exemplified configuration of the paper machine.

As shown in FIG. 6, for example, a soft calender 90A, which includes the elastic roll D and the metal roll M having one nip and four stacks, may be used instead of the multinip calendar shown in FIG. 5.

<Operation>

In the present invention, one of (1) a step of performing a flattening process by the flattening facility after coating is performed only by the roll coater coating facility, and (2) a step of performing a flattening process by the flattening facility after coating is performed only by the two coating facilities having different coating methods is selected according to need in order to perform coating.

The criterion of the selection according to need is not limited. However, for example, it is preferable that a blade coater coating facility be used if the amount of a coating material is about 6 g/m$^2$ or more, and a roll coater coating facility be used if the amount of a coating material is less than 10 g/m$^2$. In the range where the above-mentioned ranges overlap each other, one of the blade coater coating facility and the roll coater coating facility may be selected and used in consideration of purpose, use, and production efficiency. More specifically, it is preferable that the amount of the coating material coated on one surface be 2 to 10 g/m$^2$ (particularly, 5 to 7 g/m$^2$) in the case of roll coating, and the amount of the coating material coated on one surface be 6 to 15 g/m$^2$ (particularly, 7 to 9 g/m$^2$) in the case of blade coating.

The infrared ray auxiliary drying device may be used for the adjustment of the moisture percentage and the temperature control in the width direction, and whether to use the infrared ray auxiliary drying device may be appropriately determined.

In order to obtain coated paper that has different quality on the front and back surfaces thereof, an undercoating layer may be formed in the size press 40, an overcoating layer may be formed by the first blade coating machine 61 or the second blade coating machine 81, the paper may be dried in the infrared ray auxiliary drying device, the gas type air dryer, and the canvas dryer, and the paper may be led to the calendar.

If the amount of the coating material coated on one surface should be 7 g/m$^2$ or more when high speed papermaking is performed in the first blade coating machine 61 or the second blade coating machine 81, a jet fountain method, which can supply a solution at high speed, may be preferably used as an applicator and scraping is performed by a blade.

If the amount of the material coated on one surface should be less than 7 g/m$^2$, a short dowel blade coater coating facility improved for high speed may be used.

In this case, it is preferable that paper be basically discharged and fed at three (X, Y, and Z) positions at the time of paper break when coating is performed by the first blade coating facility 60 and the second coating facility 80. In contrast, it is enough that paper is basically discharged and fed at two (Y and Z) positions at the time of paper break when coating is performed by the roll coater coating facility 70.

In the above-mentioned embodiment, the blade coating facility has been exemplified as the coating facility having different coating method. However, an air knife coating facility, a curtain coating facility, and the like may be employed.

The invention claimed is:

1. A method of manufacturing coated paper that is on-line with a papermaking machine and that performs a papermaking process, a coating process, and a flattening process, wherein said papermaking process is performed by a twin wire former in which a paper material is injected from a head box to between two wires each of which loops to form a paper layer, thus making a paper web;

said coating process uses a coating facility that comprises a roll coater coating facility for coating both skies of a paper web, a first blade coater coating facility for coating one side of a paper web, and a second blade coater coating facility for coating another side of the paper web, said roll coater coating facility being provided between the first and second blade coater coating facilities, and said coating process performs said coating process on said paper web using only the roll coater coating facility when an amount of coating material to be coated on one surface of the paper web is 7 g/m$^2$ or less, and using only the first and second blade coater coating facilities when the amount of coating material to be coated on one surface of the paper web is greater than 7 g/m$^2$, and then said flattening process is performed on said paper web by a flattening facility.

2. The method of manufacturing coated paper according to claim 1, wherein a gate roll coater, a rod metering size press facility, or a two-roll size press is provided between a press part provided after the twin wire former and the first blade coater coating facility.

3. The method of manufacturing coated paper according to claim 1 or 2, wherein when said coating process is performed by only the roll coater coating facility, discharging and feeding of the paper web is performed at two positions which are between the first blade coater coating facility and the roll coater coating facility, and on a downstream side of the second blade coater coating facility; and when said coating process is performed by only the first and second blade coater coating facilities, discharging and feeding of the paper web is performed at three positions which are on an upstream side of the first blade coater coating facility, between the first blade coater coating facility and the roll coater coating facility, and on a downstream side of said second blade coater coating facility.

* * * * *